US010188206B2

(12) United States Patent
Leathead

(10) Patent No.: US 10,188,206 B2
(45) Date of Patent: Jan. 29, 2019

(54) CONVERTIBLE FURNITURE UNIT, SLAT FOR USE IN FORMING A FURNITURE UNIT AND METHOD OF USING A CONVERTIBLE FURNITURE UNIT

(71) Applicant: DESIGNARIUM, INC., Laval, Quebec (CA)

(72) Inventor: Stephane Leathead, Laval (CA)

(73) Assignee: DESIGNARIUM INC., Laval (CA)

( * ) Notice: Subject to any disclaimer, the term of this patent is extended or adjusted under 35 U.S.C. 154(b) by 0 days.

(21) Appl. No.: 15/507,064

(22) PCT Filed: Aug. 20, 2015

(86) PCT No.: PCT/CA2015/050794

§ 371 (c)(1),
(2) Date: Feb. 27, 2017

(87) PCT Pub. No.: WO2016/029300

PCT Pub. Date: Mar. 3, 2016

(65) Prior Publication Data

US 2017/0238707 A1 Aug. 24, 2017

Related U.S. Application Data

(60) Provisional application No. 62/043,524, filed on Aug. 29, 2014.

(51) Int. Cl.
*A47B 85/04* (2006.01)
*A47C 1/029* (2006.01)
(Continued)

(52) U.S. Cl.
CPC ..... *A47B 85/04* (2013.01); *A47B 3/08* (2013.01); *A47B 13/088* (2013.01); *A47C 1/029* (2013.01);
(Continued)

(58) Field of Classification Search
CPC ..... A47B 85/04; A47B 3/08; A47B 13/088; A47C 1/029; A47C 1/143; A47C 3/029; A47C 4/04; A47C 7/16; A47C 11/00
See application file for complete search history.

(56) References Cited

U.S. PATENT DOCUMENTS

D249,305 S * 9/1978 Henninger ..... D6/336
4,235,473 A * 11/1980 Aginar ..... A47C 4/022 297/440.19

(Continued)

FOREIGN PATENT DOCUMENTS

WO WO 2007/009824 1/2007

*Primary Examiner* — Hanh V Tran
(74) *Attorney, Agent, or Firm* — Brouillette Legal Inc.; Robert Brouillette

(57) ABSTRACT

The convertible furniture unit comprises a hinge member pivotally linking first and second furniture portions to allow the first and second furniture portions to relatively pivot relative to each other to adopt a number of different angular relative positions, and a locking mechanism to releasably lock the first and second furniture portion in a given angular relative position. The first and second furniture portions each comprise a number of slats that are intermeshed with and are slidable between the slats of the other one of the first and second furniture portions. Each slat comprises a hinge portion pivotally attached to the hinge member, an arm extending away from the hinge portion and a free extremity opposite the hinge portion. The first and second furniture portions are capable of adopting at least: •a first position wherein the arms of the slats of the first furniture portion extend away from the hinge member and through the arms of the slats of the second furniture portion; and •a second position in which the arms of the slats of the first furniture portion extend away from hinge and away from the arms of the slats of the second furniture portion without crossing or extending through the arms of the slats of the second
(Continued)

furniture portion. The first and second positions of the first and second furniture portions are both operable for use of the furniture unit by a user.

10 Claims, 6 Drawing Sheets

(51) Int. Cl.

| | |
|---|---|
| ***A47C 1/14*** | (2006.01) |
| ***A47C 3/029*** | (2006.01) |
| ***A47C 4/04*** | (2006.01) |
| ***A47C 11/00*** | (2006.01) |
| ***A47B 3/08*** | (2006.01) |
| ***A47B 13/08*** | (2006.01) |
| ***A47C 7/16*** | (2006.01) |
| ***A47C 13/00*** | (2006.01) |

(52) U.S. Cl.
CPC ..... *A47C 1/143* (2013.01); *A47C 3/029* (2013.01); *A47C 4/04* (2013.01); *A47C 7/16* (2013.01); *A47C 11/00* (2013.01); *A47C 13/00* (2013.01); *A47B 2220/0055* (2013.01)

(56) References Cited

U.S. PATENT DOCUMENTS

| | | | | |
|---|---|---|---|---|
| 4,278,288 | A * | 7/1981 | Thebaud | A47C 1/032 297/118 |
| 4,322,109 | A * | 3/1982 | Thebaud | A47C 4/022 108/118 |
| 6,174,585 | B1 * | 1/2001 | Miles | A47B 85/00 297/118 |
| 6,824,221 | B1 * | 11/2004 | Tiffany, III | A47C 4/022 297/451.4 |
| 2004/0222676 | A1 * | 11/2004 | Okabayashi | A47C 7/024 297/29 |
| 2013/0033074 | A1 * | 2/2013 | Daly | A47C 1/146 297/183.1 |
| 2016/0302581 | A1 * | 10/2016 | Szonyi | A47C 11/00 |
| 2017/0127841 | A1 * | 5/2017 | Lee | A47C 7/563 |

* cited by examiner

CONVERTIBLE FURNITURE UNIT, SLAT FOR USE IN FORMING A FURNITURE UNIT AND METHOD OF USING A CONVERTIBLE FURNITURE UNIT

CROSS-REFERENCE DATA

The present application claims the priority of U.S. provisional patent application No. 60/043,524 filed on Aug. 29, 2014.

FIELD OF THE INVENTION

The present invention relates to convertible furniture units, and more particularly to a convertible furniture unit that has two portions pivotable relative to each other, each comprising a number of slats that are intermeshed with the slats of the other portion; to a slat for use in forming this furniture unit; and to a method of using this convertible furniture unit.

BACKGROUND OF THE INVENTION

Convertible furniture units are known. Some include two portions that are pivotable relative to each other. However, none provide a wide range of relative angular positions for its pivotable portions and allowing the furniture portions to be used with full flexibility to adopt different furniture configurations.

SUMMARY OF THE INVENTION

The invention relates to a convertible furniture unit comprising a hinge member pivotally linking first and second furniture portions to allow said first and second furniture portions to relatively pivot relative to each other to adopt a number of different angular relative positions, and a locking mechanism to releasably lock said first and second furniture portion in a given angular relative position, said first and second furniture portions each comprising a number of slats that are intermeshed with and are slidable between the slats of the other one of said first and second furniture portions, each said slat comprising a hinge portion pivotally attached to said hinge member, an arm extending away from said hinge portion and a free extremity opposite said hinge portion, said first and second furniture portions being capable of adopting at least:

- a first position wherein said arms of said slats of said first furniture portion extend away from said hinge and through said arms of said slats of said second furniture portion; and
- a second position in which said arms of said slats of said first furniture portion extend away from hinge and away from said arms of said slats of said second furniture portion without crossing or extending through said arms of said slats of said second furniture portion;

wherein said first and second positions of said first and second furniture portions are both operable for use of said furniture unit by a user.

In one embodiment, said arms of said slats are arcuate and define opposite convex and concave sides, with both said convex and concave sides being usable either as load-supporting surfaces or for facing towards the ground when said convertible furniture unit rests on the ground, depending on the relative angular position of said first and second furniture portions.

In one embodiment, in said second position of said first and second furniture portions, said furniture unit defines three ground-bearing surfaces for resting on the ground: (a) said free extremities of said slats of said first furniture portion, (b) said free extremities of said slats of said second furniture portion, and (c) said hinge member; and wherein said convex sides of said slats of said first and second furniture portions face away from the ground and are usable as a load-bearing surface.

In one embodiment, in said first position of said first and second furniture portions, said furniture unit defines two ground-bearing surfaces for resting on the ground: (i) said free extremities of said slats of said first furniture portion, and (b) said hinge member; and wherein only part of said convex side of said slats of said first furniture portion and part of said concave side of said slats of said second furniture portion are usable as a load-bearing surface.

In one embodiment, said hinge member comprises a hollow tube on which said first and second furniture portions are mounted, and said hinge portions of said slats comprise ring portions that are rotatably engaged about said tube.

In one embodiment, said slats of said first furniture portion are attached to each other at their said free extremities; said slats of said second furniture portion are attached to each other at their said free extremities; and said first and second furniture portions are pivotable of a full 360° about said hinge member and are pivotable relative to each other between the abutment of said free extremities of said first and second furniture portions, with all relative positions of said first In an alternate embodiment, said slats of said first and second furniture portion are independently mounted to said hinge member and are free to rotate of a full 360° about said hinge member notwithstanding the relative position of said first and second furniture portions, with all relative positions of said first and second furniture portions being operable for resting on the ground and receiving a load.

In one embodiment, said locking mechanism comprises said slats of said first and second furniture portions frictionally sliding with respect to each other.

In one embodiment, said locking mechanism comprises said slats of said first and second furniture portions frictionally engaging said hinge member.

The present invention further relates to a slat for use in forming a furniture unit as defined in claim 2.

The present invention also relates to a method of using a furniture unit as defined in claim 2, said method comprising transforming said furniture unit into one of a number of operable configurations by relatively pivoting said first and second furniture portions, with the step of transforming said furniture unit comprising allowing the slats of the first and second furniture portions to slide in-between each other such that the slats of said first furniture portion are capable of extending through or away from the slats of said second furniture portion.

DETAILED DESCRIPTION OF THE EMBODIMENTS

Figure 1:
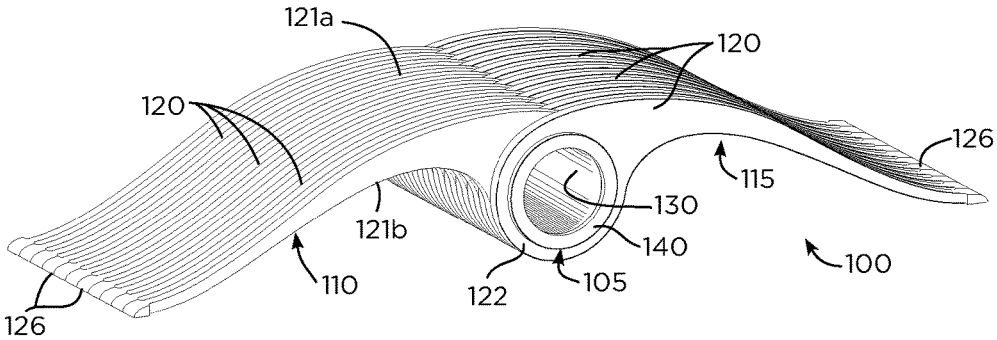
FIG. 1 is a perspective view of the convertible furniture unit according to one embodiment of the present invention and in a first configuration.
Figure 2:
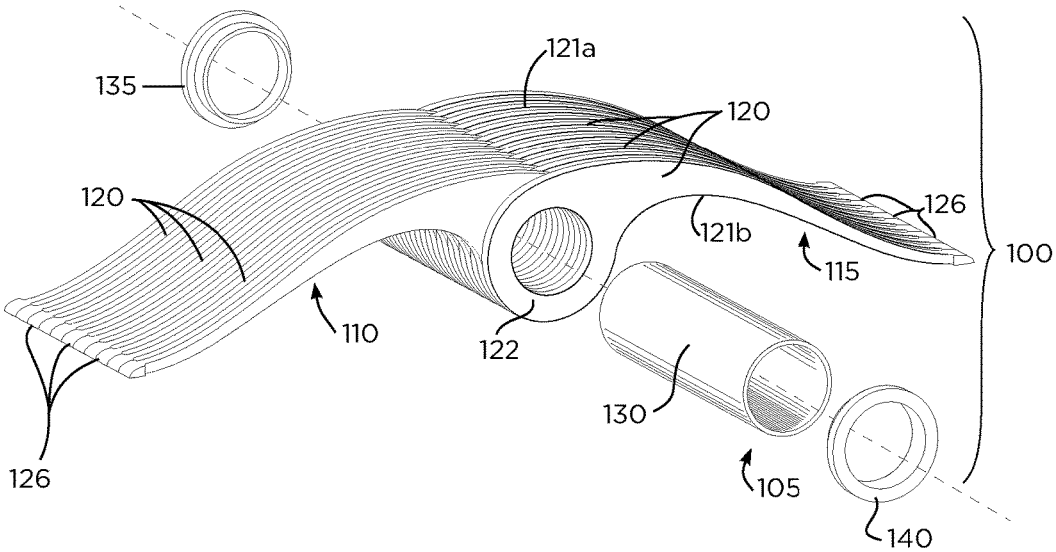
FIG. 2 is an exploded perspective view of the convertible furniture unit of FIG. 1.

FIGS. 1 and 2 show a convertible furniture unit 100 according to the present invention. Furniture unit 100 can adopt one of many different configurations to accommodate its user so as to use furniture unit as a chair with reclinable backrest, long chair, rocking chair, bench, table, etc.; as will be detailed hereinafter. The purpose of furniture unit is mainly as a load-supporting furniture, such a chair, bench or table.

More particularly, furniture unit 100 comprises a hinge member 105 pivotally linking first and second furniture portions 110, 115 to allow first and second furniture portions 110, 115 to pivot relative to each other.

Figure 3:
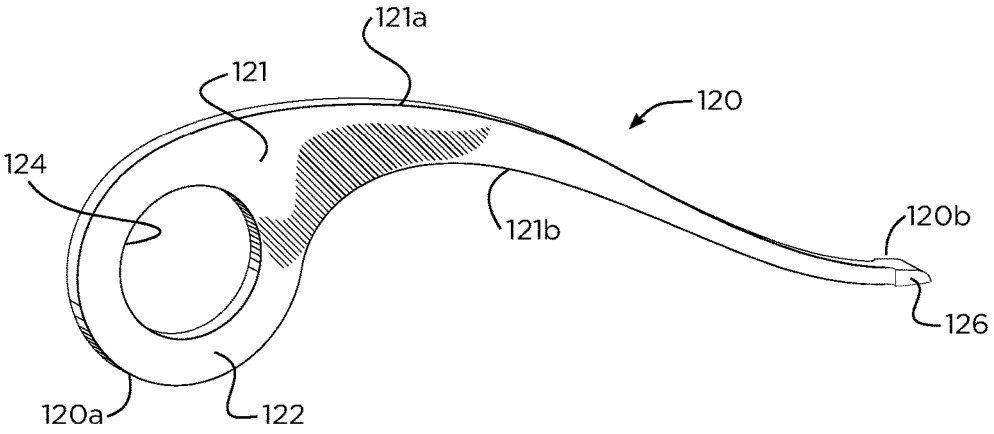
FIG. 3 is an enlarged perspective view of a slat used to form the furniture unit of FIG. 1.

First and second furniture portions 110, 115 are each composed of a number of slats 120. One such slat 120 is shown in FIG. 3. Slat 120 is narrow, flat and generally elongated and defines opposite first and second ends 120*a*, 120*b*. At its first end 120*a*, slat 120 comprises a ring portion 122 that has an opening 124 therein. At its second end 120*b*, slat 120 comprises a flat attachment tab 126 that is slightly wider than the remaining portion of slat 120. Slat 120 has an arcuate arm 121 that extends between ring portion 122 and tab 126. Arcuate arm 121 defines a convex side 121*a* and a concave side 121*b*.

Hinge 105 comprises a hollow tube 130 and a pair of annular flanges 135, 140 that are friction-fitted in respective extremities of hollow tube 130, although they could alternately be snap-fitted or threaded.

FIGS. 1 and 2 show that slats 120 that compose first furniture portion 110 are disposed in parallel and juxtaposed configuration albeit being slightly spaced-apart. The openings 124 of ring portions 122 are engaged by the hollow tube 130 of hinge member 105 such that ring portions 122 are rotatable about hollow tube 130 and arcuate arms 121 are pivotable about hollow tube 130.

The attachment tabs 126 of slats 120 are in contact with the other adjacent tabs 126 to form a line of tabs 126 that are attached to each other, for example by extending a single pin (not shown) through the entire length of adjacent tabs or by attaching each tab 126 with other adjacent tabs 126 independently. Consequently, this attachment of tabs 126 will allow each furniture portion 110, 115 to pivot as a unit about hinge member 105.

Slats 120 that form the second furniture portion 115 are disposed and arranged similarly to those of first furniture portion 115.

Slats 120 of first furniture portion 110 are inserted about tube 130 alternately with slats 120 of second furniture portion 115, such that slats 120 of first and second furniture portions 110, 115 are intermeshed to allow relative sliding of slats 120 of one of first and second furniture portions 110, 115 in-between slats 120 of the other of first and second furniture portions 110, 115 when first and second furniture portions 110, 115 are pivoted with respect to one another.

Flanges 135, 140 are installed after all slats 120 are inserted about tube 130, to prevent accidental disengagement of slats 120 from tube 130, in the axial direction of tube 130.

The furniture unit 100 according to the present invention is mainly composed of a single structural element in the form of the slat 120 that is used a desired number of times to form the furniture unit. For example, in the annexe drawings, first furniture portion 110 comprises eleven slats 120 and second furniture portion 115 comprises twelve slats 120, although these numbers could be modified as desired. The only other elements forming the furniture unit 100 are the hinge 105 and the attachments (not shown) of the slat tabs 126.

The present invention also comprises a method of using furniture unit 100 that comprises transforming furniture 100 unit into one of a number of operable configurations by pivoting first and second furniture portions 110, 115. More particularly, first and second furniture portions 110, 115 can pivot relative to one another until tabs 126 abut against each other and otherwise adopt any relative angular position by simply relatively pivoting the first and second furniture portions 110, 115, as suggested by a first alternate position shown in FIGS. 4 and 5; a second alternate position shown in FIGS. 6 and 7; and a third alternate position shown in FIGS. 8 and 9.

Furniture unit 100 can be used differently according to the adopted configuration. For example, in the configuration of FIGS. 1 and 2, furniture unit 100 can be used as a bench suitable for receiving one or two persons sitting atop the convex sides 121*a* of slats 120 near their annular portions 122, or as a table. In this configuration, furniture unit 100 rests on the ground at the annular portions 122 of the slats 120 and at the slat tabs 126.

Figure 4:
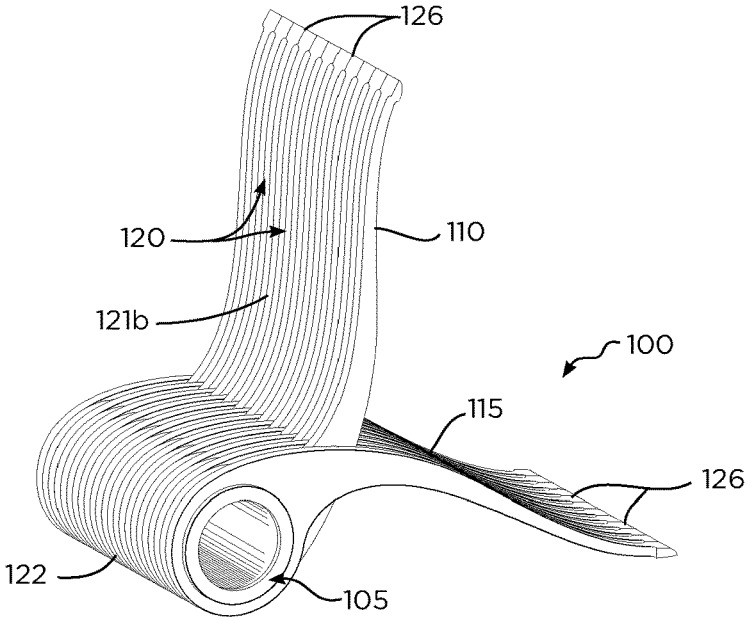
FIGS. 4 and 5 are respectively similar to FIGS. 1 and 2, but with the furniture unit in a first alternate configuration.
Figure 5:
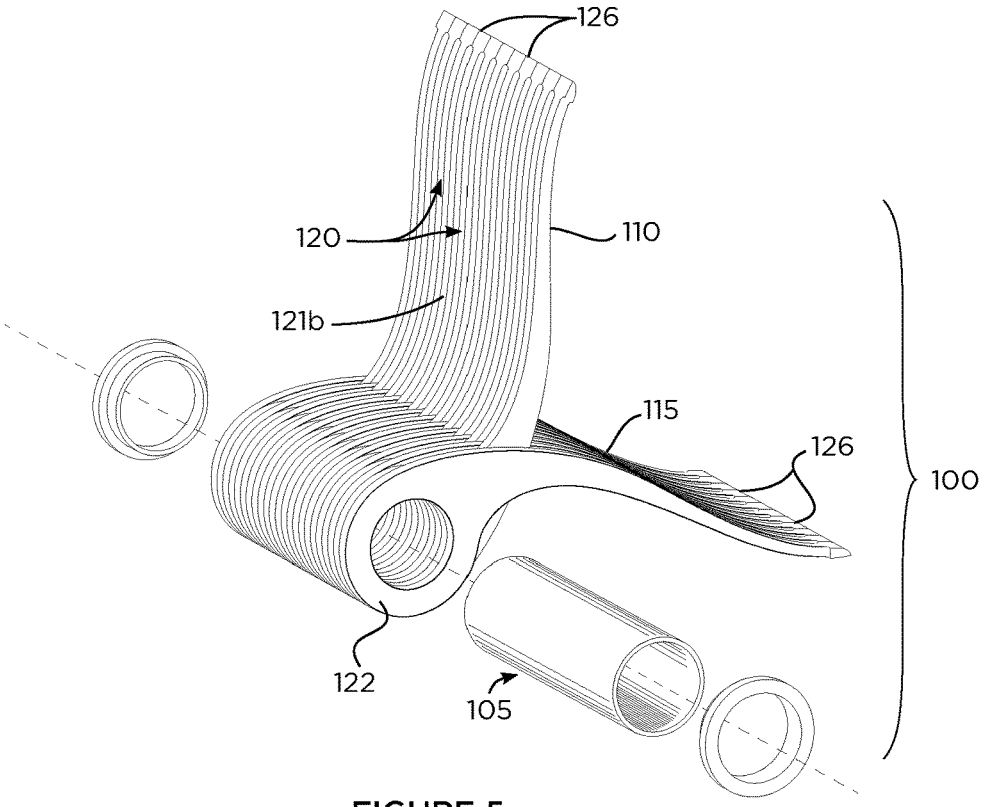

In the configuration of FIGS. 4 and 5, furniture unit 100 can be used as a chair resting on the ground with annular portions 122 of slats 120 and with the tabs 126 of second furniture portion 115. A person sitting on furniture unit 100 will rest atop annular portions 122 and will use the concave portion 121*b* of slats 120 of the first furniture portion 110 as the backrest.

Figure 6:
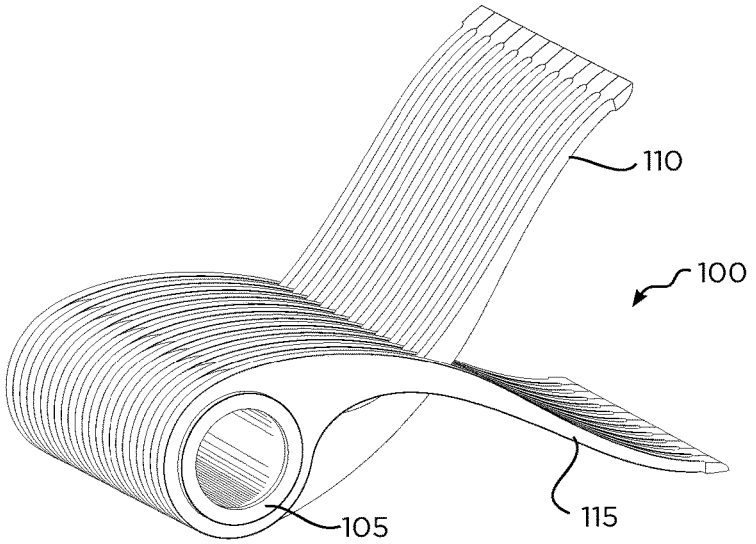
FIGS. 6 and 7 are respectively similar to FIGS. 1 and 2, but with the furniture unit in a second alternate configuration.
Figure 7:
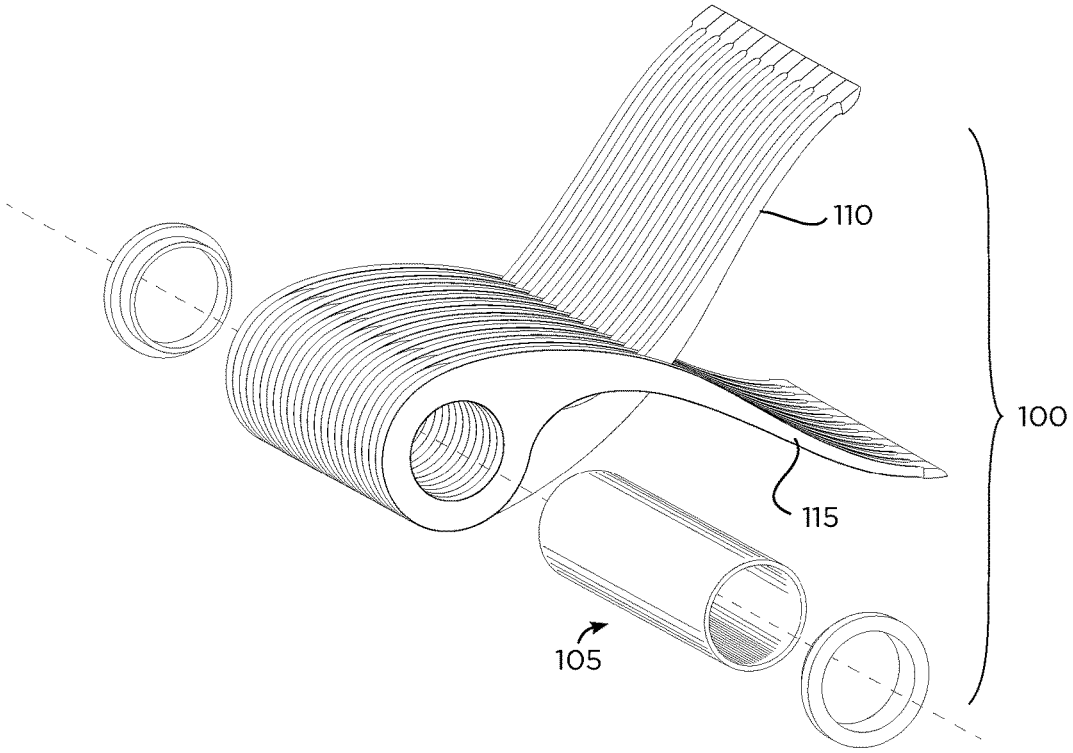

The configuration of FIGS. 6 and 7 is similar to that of FIGS. 4 and 5, however the backrest formed by first furniture portion 110 is reclined towards second furniture portion 115 at a more acute angle, such that a person sitting in furniture unit 100 would lean backwards more than when sitting in furniture unit 100 according to the configuration of FIGS. 4 and 5.

Figure 8:
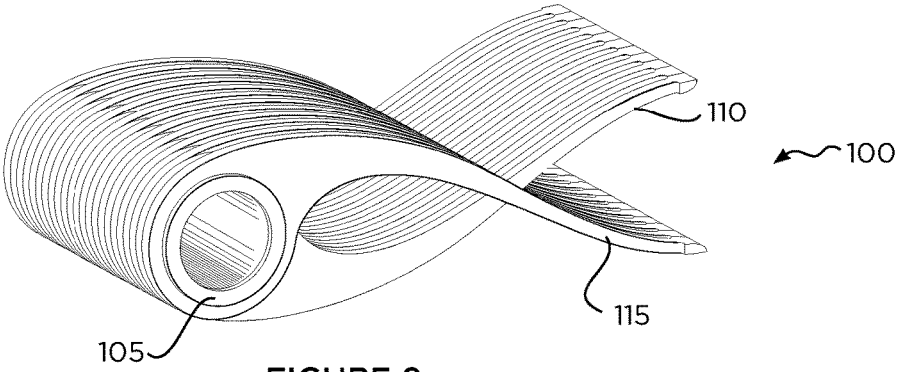
FIGS. 8 and 9 are respectively similar to FIGS. 1 and 2, but with the furniture unit in a third alternate configuration.
Figure 9:
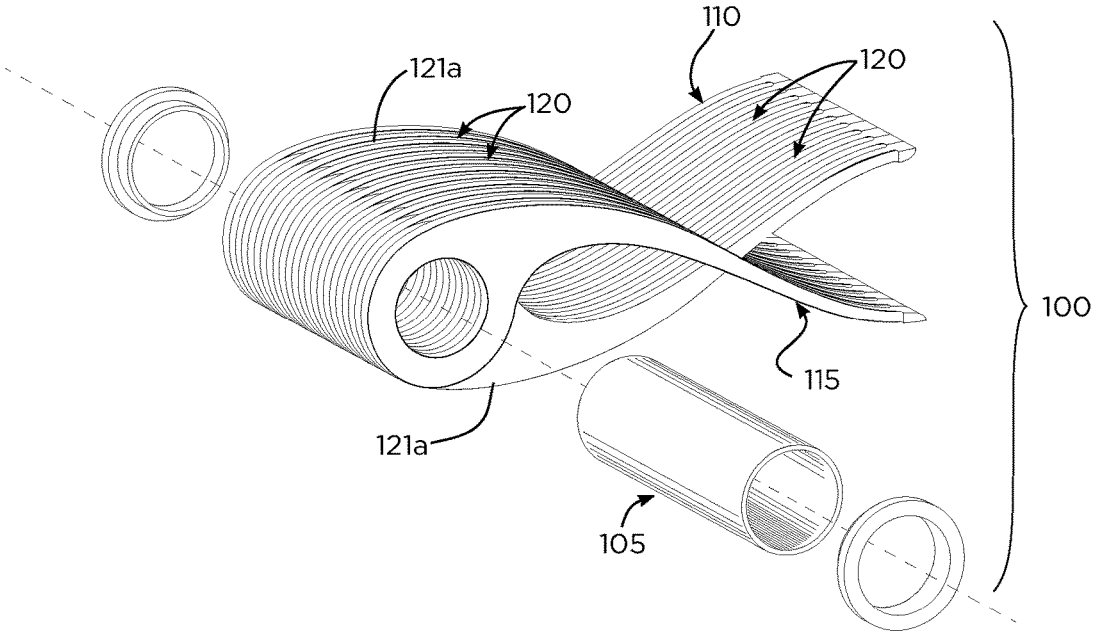

The configuration of FIGS. 8 and 9 is one where furniture unit 100 can be used as a bench suitable for receiving one person sitting atop the convex side 121*a* of slats 120 of second furniture portion 115 near their annular portions 122. Furniture unit here rests on the ground with the convex side 121*a* of first furniture portion 110 and with tabs 126 of second furniture portion. The configuration of FIGS. 8 and 9 is also more compact, to allow furniture unit 100 to be stored or carried more easily.

The different configurations of furniture unit 100 can be adopted without collapsing by means of a locking mechanism. This locking mechanism comprises slats 120 of first and second furniture portions 110, 115 tightly engaging hinge member 105 and/or being tightly fitted between the slats 120 of the other furniture portion 110, 115. In an embodiment where the locking mechanism comprises slats 120 being frictionnally engaged between each other, annular flanges 135, 140 will be forced inwardly along the axis of hinge member 105 to force slats 120 against each other. Alternately, another locking mechanism could be envisioned to releasably set the relative position of the first and second furniture portions 110, 115 such as set screws, transverse pins or the like.

Figure 10:
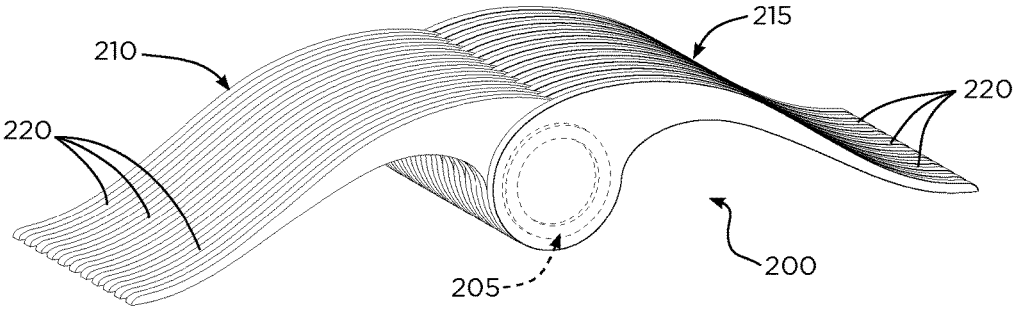
FIGS. 10 and 11 are respectively similar to FIGS. 1 and 2, but showing a furniture unit according to a second embodiment of the invention, and with the hinge being shown in dotted lines in FIG. 10.
Figure 11:
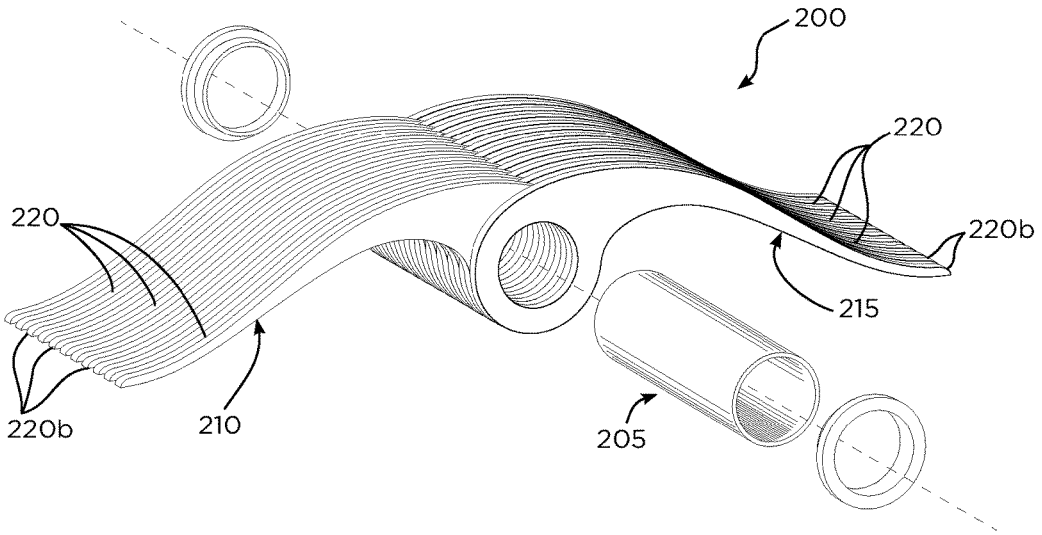

FIGS. 10 and 11 show a furniture unit 200 according to a second embodiment of the invention that is similar to the first embodiment of FIGS. 1-9, except that the slats 220 forming the first and second furniture portions 210, 215 have no attachment tabs at their second ends 220*b*. Slats 220 are consequently not attached to one another except as they engage hinge member 205. This means that each slat 220 is free to pivot independently from the other slats 220 forming a same furniture portion 210 or 215. This is slightly less practical in that the slats might have to be moved individually to configure furniture unit 200 similarly to the configurations shown in FIGS. 1-9. However it provides additional flexibility in forming configurations wherein the slats 220 of a same furniture portion 210 or 215 could conceivably be positioned at different angular positions.

The furniture portions 110, 115 of the first embodiment are allowed to pivot a full 360° albeit being limited by the position of the other furniture portion, i.e. the slat tabs 126 cannot move through the slats tabs of the other furniture unit. In the embodiment of FIGS. 10 and 11, there is no limit to the pivotal displacement of the furniture portions 210, 215, since the slats 220 are rotatable around hinge 205 of a full 360° without restriction.

Both in the first and the second embodiment of the invention, the flexibility allowed by the slat-formed furniture portions allows the first and second furniture portions to adopt at least:

- a first position wherein the arms of the slats of the first furniture portion extend away from the hinge and through the arms of the slats of the second furniture portion, as seen for example in FIGS. 4-9; and
- a second position in which the arms of the slats of the first furniture portion extend away from hinge and away from the arms of the slats of the second furniture portion without crossing or extending through the arms of the slats of the second furniture portion, as seen for example in FIGS. 1 and 2;

wherein these first and second positions of the first and second furniture portions are both operable for use of the furniture unit by a user. This provides to the user the choice of using an entire section of a furniture portion as a load-bearing surface, or only part thereof. For example, in FIGS. 1-2, the entire length of the slats of the first and second furniture portions are usable to support a load; while in FIGS. 4-5, part of the second furniture portion is used as a seat, and part of the first furniture portion is used as a backrest.

Also, with the arms of the slats being arcuate and defining opposite convex and concave sides, both the convex and concave sides become usable either as load-supporting surfaces or for facing towards the ground, depending on the relative angular position of the first and second furniture portions. This allows multiple types of uses for the furniture unit, including some where the backrest or seat portions are curved for increased comfort of the user.

The invention thus also defines a method of using a furniture unit as defined above, comprising transforming the furniture unit into one of a number of operable configurations by relatively pivoting the first and second furniture portions, with the step of transforming the furniture unit comprising allowing the slats of the first and second furniture portions to slide in-between each other such that the slats of the first furniture portion are capable of extending through or away from the slats of the second furniture portion.

The invention claimed is:

1. A convertible furniture unit comprising a hinge member pivotally linking first and second furniture portions to allow said first and second furniture portions to relatively pivot relative to each other to adopt a number of different angular relative positions, and a locking mechanism to releasably lock said first and second furniture portions in a given angular relative position, said first and second furniture portions each comprising a number of slats that are intermeshed with and are slidable between the slats of the other one of said first and second furniture portions, each said slat comprising a hinge portion pivotally attached to said hinge member, an arm extending away from said hinge portion and a free extremity opposite said hinge portion, said first and second furniture portions being capable of adopting at least:

- a first position wherein said arms of said slats of said first furniture portion extend away from said hinge member and between two adjacent said arms of said slats of said second furniture portion; and
- a second position in which said arms of said slats of said first furniture portion extend away from said hinge member and away from said arms of said slats of said second furniture portion without extending between two adjacent said arms of said slats of said second furniture portion;

wherein said first and second positions of said first and second furniture portions are both operable for use of said furniture unit by a user.

2. A convertible furniture unit as defined in claim 1 wherein said arms of said slats are arcuate and define opposite convex and concave sides, with both said convex and concave sides being usable either as load-supporting surfaces or for facing towards the ground when said convertible furniture unit rests on the ground, depending on the relative angular position of said first and second furniture portions.

3. A convertible furniture unit as defined in claim 2, wherein in said second position of said first and second furniture portions, said furniture unit defines three ground-bearing surfaces for resting on the ground: (a) said free extremities of said slats of said first furniture portion, (b) said free extremities of said slats of said second furniture portion, and (c) said hinge member; and wherein said convex sides of said slats of said first and second furniture portions face away from the ground and are usable as a load-bearing surface.

4. A convertible furniture unit as defined in claim 3, wherein in said first position of said first and second furniture portions, said furniture unit defines two ground-bearing surfaces for resting on the ground: (i) said free extremities of said slats of said first furniture portion, and (b) said hinge member; and wherein only part of said convex side of said slats of said first furniture portion and part of said concave side of said slats of said second furniture portion are usable as a load-bearing surface.

5. A convertible furniture unit as defined in claim 2, wherein said hinge member comprises a hollow tube on which said first and second furniture portions are mounted, and said hinge portions of said slats comprise ring portions that are rotatably engaged about said tube.

6. A convertible furniture unit as defined in claim 2, wherein said slats of said first furniture portion are attached to each other at their said free extremities; said slats of said second furniture portion are attached to each other at their said free extremities; and said first and second furniture portions are pivotable of a full 360° about said hinge member and are pivotable relative to each other between the abutment of said free extremities of said first and second furniture portions, with all relative positions of said first and second furniture portions being operable for resting on the ground and for receiving a load.

7. A convertible furniture unit as defined in claim 2, wherein said slats of said first and second furniture portion are independently mounted to said hinge member and are free to rotate of a full 360° about said hinge member notwithstanding the relative position of said first and second furniture portions, with all relative positions of said first and second furniture portions being operable for resting on the ground and receiving a load.

8. A convertible furniture unit as defined in claim 2, wherein said locking mechanism comprises said slats of said first and second furniture portions frictionally sliding with respect to each other.

9. A convertible furniture unit as defined in claim 2, wherein said locking mechanism comprises said slats of said first and second furniture portions frictionally engaging said hinge member.

10. A method of using a furniture unit, said furniture unit comprising a hinge member pivotally linking first and second furniture portions to allow said first and second furniture portions to relatively pivot relative to each other to adopt a number of different angular relative positions, and a locking mechanism to releasably lock said first and second furniture portions in a given angular relative position, said first and second furniture portions each comprising a number of slats that are intermeshed with and are slidable between the slats of the other one of said first and second furniture portions, each said slat comprising a hinge portion pivotally attached to said hinge member, an arm extending away from said hinge portion and a free extremity opposite said hinge portion, said first and second furniture portions being capable of adopting at least:

a first position wherein said arms of said slats of said first furniture portion extend away from said hinge member and between the two adjacent said arms of said slats of said second furniture portion; and a second position in which said arms of said slats of said first furniture portion extend away from said hinge member and away from said arms of said slats of said second furniture portion without extending between the two adjacent said arms of said slats of said second furniture portion;

wherein said first and second positions of said first and second furniture portions are both operable for use of said furniture unit by a user, wherein the arms of said slats are arcuate and define opposite convex and concave sides, with both said convex and concave sides being usable either as load-supporting surfaces or for facing towards the ground when said convertible furniture unit rests on the ground, depending on the relative angular position of said first and second furniture portions, said method comprising transforming said furniture unit into one of a number of operable configurations by relatively pivoting said first and second furniture portions, with the step of transforming said furniture unit comprising allowing the slats of the first and second furniture portions to slide in-between each other such that the slats of said first furniture portion are capable of extending through or away from the slats of said second furniture portion.

* * * * *